United States Patent [19]

Kahmann et al.

[11] 4,402,463

[45] Sep. 6, 1983

[54] GRINDING APPARATUS FOR A SUSPENSION OF FIBRES FOR PAPER MANUFACTURING

[75] Inventors: Albrecht Kahmann; Rainer Meisenberg, both of Weingarten, Fed. Rep. of Germany

[73] Assignee: Escher Wyss GmbH, Ravensburg, Fed. Rep. of Germany

[21] Appl. No.: 294,623

[22] Filed: Aug. 20, 1981

[30] Foreign Application Priority Data

Sep. 5, 1980 [CH] Switzerland ..... 6680/80

[51] Int. Cl.[3] ..... B02C 7/14

[52] U.S. Cl. ..... 241/37; 241/259.2

[58] Field of Search ..... 241/37, 259.2, 259.3, 241/286, 261.2, 290, 261.3

[56] References Cited

U.S. PATENT DOCUMENTS

| | | | |
|---|---|---|---|
| 3,276,701 | 10/1966 | Fisher | 241/259.2 X |
| 3,420,458 | 1/1969 | Yli-Paavola | 241/290 |
| 3,604,645 | 9/1971 | Keyes | 241/37 |
| 3,810,584 | 5/1974 | Kahmann | 241/37 |
| 3,847,359 | 11/1974 | Holmes et al. | 241/37 X |

*Primary Examiner*—Mark Rosenbaum

*Attorney, Agent, or Firm*—Werner W. Kleeman

[57] ABSTRACT

A housing is equipped with a set of grinding tools and a rotor equipped with a second set of grinding tools. One of the parts carrying the grinding tool set is moveable in relation to the other part, which may be constituted by the rotor, in axial direction of the rotor and can be adjusted by a piston-and-cylinder unit impingeable with a pressurized fluid medium, preferably compressed air. The compressed air infeed into the piston-and-cylinder unit is accomplished by a compensation force regulator controlled as a function of the pressure of the stock suspension within the internal compartment of the housing and a grinding force regulator controlled independently of the compensation force regulator in accordance with a set value signal infed by a control line. The pressure force exerted upon the one moveable part therefore is the resultant of a first force component influenced by the compensation force regulator and corresponding to a compensation force which compensates the pressure force of the stock suspension and a second force component influenced by the grinding force regulator and adjustable in accordance with a predetermined grinding force. Thus, there prevails a substantially constant grinding load which is practically independent of possible changes of the stock suspension pressure within the housing.

9 Claims, 4 Drawing Figures

GRINDING APPARATUS FOR A SUSPENSION OF FIBRES FOR PAPER MANUFACTURING

BACKGROUND OF THE INVENTION

The present invention relates to a new and improved construction of a grinding apparatus for fibres contained in a stock suspension for use in the paper industry, especially for the fabrication of paper.

Generally speaking, the grinding apparatus of the invention is of the type comprising a housing within which there is rotatably mounted a rotor equipped with at least one grinding tool set and possessing a wall portion or part equipped with a second grinding tool set. In order to adjust the grinding gap between both of the grinding tool sets one of the parts carrying the grinding tool sets is moveably guided in relation to the other part in axial direction of the rotor towards such other part and away from the latter and can be adjusted by means of a piston-and-cylinder unit or device which can be impinged with a pressurized fluid medium. The piston-and-cylinder unit contains a contact or pressing chamber which is effective in the sense of bringing together or having the grinding tool sets approach one another and a lift-off chamber which is effective in a lift-off direction for shifting apart the grinding tool sets.

According to a prior art grinding apparatus of the afore-mentioned type, as disclosed in German Pat. No. 2,146,548 and the corresponding U.S. Pat. No. 3,810,584, granted May 14, 1974, the piston-and-cylinder unit contains an auxiliary or additional piston which is not connected with the main piston and can be axially displaced and fixedly positioned in relation to the main piston. This auxiliary piston forms a stop or impact member which limits the adjustment movement of the moveable part of the piston-and-cylinder unit in a direction corresponding to bringing together of the grinding tool sets or fittings. The cylinder chambers of this known grinding apparatus are connected with a hydraulic actuation system, by means of which there can be impinged with the momentarily required pressure each of the cylinder chambers or spaces. The actuation of the auxiliary piston requires a separate control arrangement which must be supervised or monitored. Standing in opposition to the known equipment design is the requirement that there be afforded as simple as possible construction of the grinder apparatus, and in this respect there is strived for a design having as few as possible moveable, robust and easily exchangeable components.

SUMMARY OF THE INVENTION

Hence, with the foregoing in mind it is a primary object of the present invention to provide a new and improved construction of grinding apparatus for fibres contained in a suspension for use in the paper industry which extensively satisfies these requirements.

Another and more specific object of the invention aims at further improving upon the grinding apparatus of the prior art discussed above in terms of the requirements mentioned, and which particularly manifests itself through an especially simple constructional design and a correspondingly improved handling and operation of the grinding apparatus.

Still a further significant object of the invention aims at providing a new and improved construction of grinding apparatus for a suspension of fibres for paper manufacturing, which apparatus is relatively simple in construction and design, extremely reliable in operation, not readily subject to breakdown or malfunction and requires a minimum of maintenance and servicing.

Now in order to implement these and still further objects of the invention, which will become more readily apparent as the description proceeds, the grinding apparatus of the present development is manifested by the features that there is provided a regulation on regulator device for influencing the pressure of the pressurized fluid medium. The regulation device contains a compensation force regulator which, during operation, effectuates as a function of the pressure prevailing within the internal space or compartment of the housing a compensation of the compressive or pressure force effective by such pressure upon the moveable part. The compensation force regulator is connected by means of a signal line with a pressure pick-up or pressure measuring device serving for measuring the pressure of the suspension within the housing. The compensation force regulator places the pressure of the pressurized fluid medium at a pressure which is in a certain or predestined relationship to the pressure of the suspension. Also, there is provided a grinding force regulator which, as a function of a set or reference value signal, influences the pressure of the pressurized fluid medium and enables adjustment of a desired grinding force.

By virtue of the inventive arrangement there can be dispensed with the installation of an auxiliary piston constituting a stop or impact member for the main or primary piston. Also, due to the separate influencing of both components of the pressure or compressive force—also referred to herein as the pressing or contact force—which is formed from the grinding force and the compensation force compensating the internal pressure of the housing there is also obtained, even in the presence of fluctuating pressure conditions in the grinding apparatus, an essentially constant grinding load.

According to one embodiment of the invention there can be realized a differential influencing of each of both components of the pressing or contact force in that with at least two different pressing or pressure spaces of the piston-and-cylinder unit or device and which are effective in the same direction, the compensation force regulator and the grinding force regulator are arranged in separate infeed lines for the pressurized fluid medium and which each lead to a respective one of the pressing chambers or spaces.

According to another design of the invention, requiring a particularly simple regulation arrangement, the separate influencing of both components of the pressing or contact force can also be ensured in that the compensation force regulator and the grinding force regulator are grouped together in a common regulation device and affect a common pressure regulator valve.

In order to initiate a positive and rapid load relief of the grinding apparatus in the presence of operational disturbances, caused for instance by an absence of stock, i.e., an absence of the suspension, it is advantageous, according to a further aspect of the invention, if there is provided a control device which enables switching the infeed of the pressurized fluid medium or pressurized medium from the pressing or contact chamber to the lift-off chamber, and if the regulation valve located in the line leading to the pressing chamber is shunted or bridged by a one-way valve. This oneway valve enables a rapid outflow of the medium from the pressing or contact chamber.

A rapid response of the control device to any encountered disturbance can be ensured for a particularly simple and reliable manner if the control device is connected to a safety regulator. This safety regulator is connected by a signal line with the pressure pick-up for measuring the pressure of the suspension in the housing. The safety regulator, upon exceeding a predetermined value of the pressure of the suspension, places the control device into a lift-off position.

According to a particularly advantageous system design it is contemplated, according to the invention, to utilize as the pressurized medium compressed air. This design enables achieving an appreciably simpler construction of the adjustment device than when using a hydraulic pressurized fluid medium, especially also in consideration of the positive supply of the pressurized fluid medium, since the grinding apparatus can be connected with the compressed air network which is practically always available in installations for fabricating paper. A further advantage of this system lay-out resides in the fact that the compressible pressurized medium, upon passage of a foreign body through the grinding gap, always allows for an elastic yielding of the moveable part of the grinding tool set or grinding tools, without there being needed for this purpose a separate regulation operation.

According to a further construction of the invention there can be realized a grinding apparatus having a particularly compact construction if the moveable part is constituted by an intermediate wall of the housing. This intermediate wall is enclosed by a fixed outer wall which forms one of the cylinder chambers or spaces within which the intermediate wall is guided in the manner of a piston within a cylinder.

BRIEF DESCRIPTION OF THE DRAWINGS

The invention will be better understood and objects others than those set forth above, will become apparent when consideration is given to the following detailed description makes reference to the annexed drawings wherein.

DETAILED DESCRIPTION OF THE PREFERRED EMBODIMENTS

Figure 1:
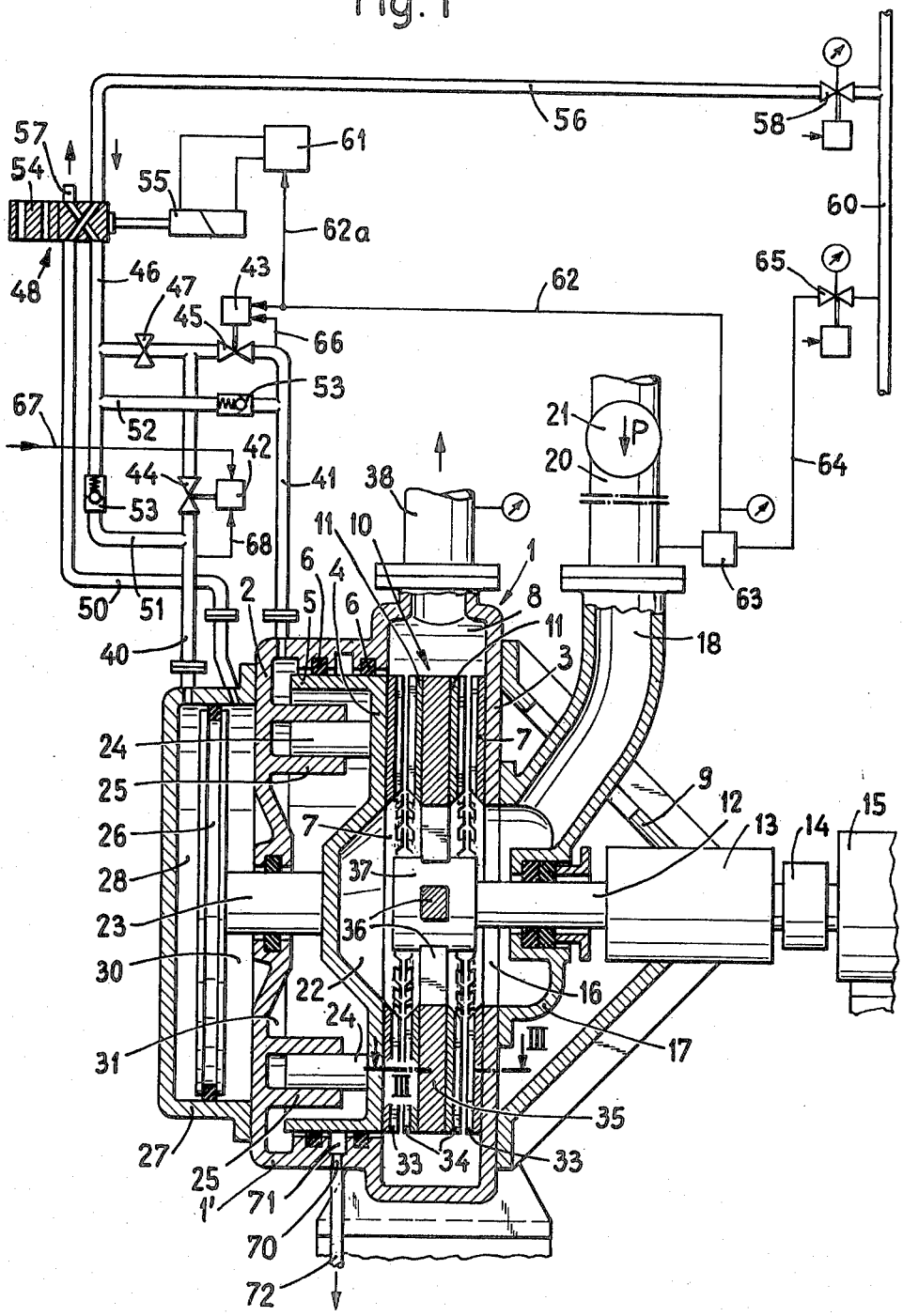
FIG. 1 schematically and partially illustrates a grinding apparatus in a fragmentary sectional view according to a first embodiment of the invention.
Figure 2:
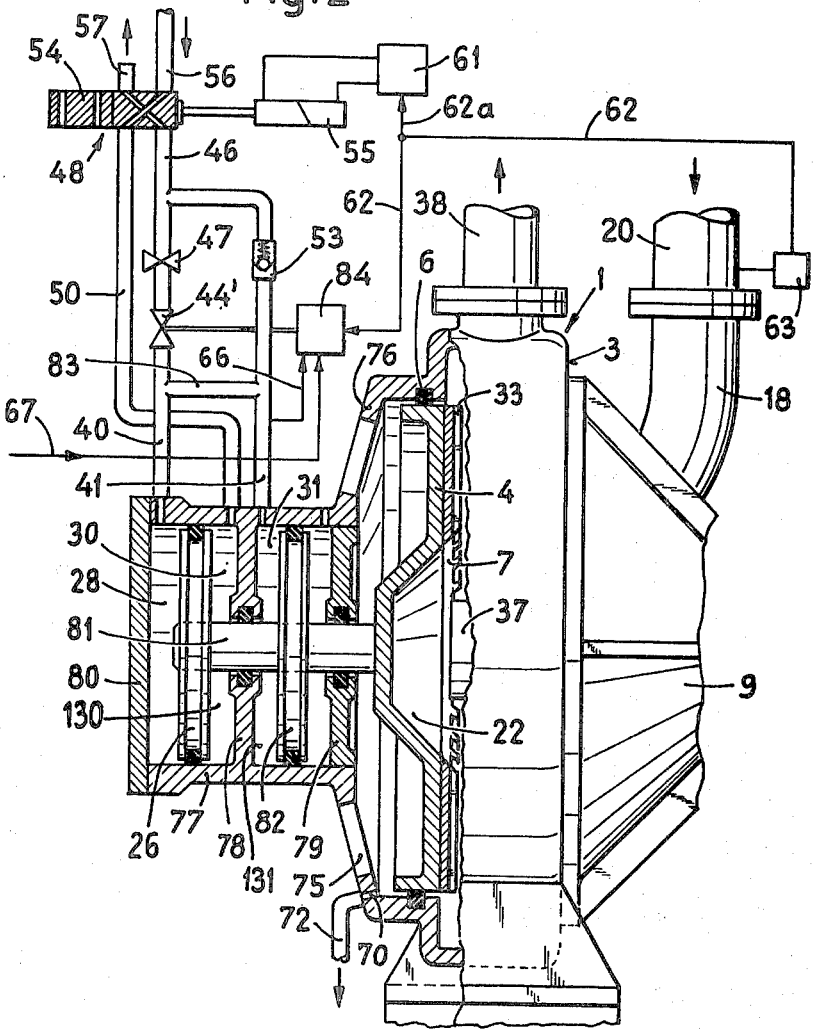
FIG. 2 again illustrates part of a grinding apparatus according to a second embodiment of the invention and in fragmentary sectional view similar to the showing of FIG. 1.

Describing now the drawings, it is to be understood that only enough of the construction of the grinding apparatus of the present development has been illustrated therein to simplify the showing and sufficient to enable those skilled in the art to readily understand the underlying principles and concepts of the present development. Turning attention now to FIGS. 1 and 2, the grinding apparatuses illustrated therein are so-called "disc refiners", as the same have application in the paper industry for preparing the stock which is to be processed in a papermaking machine. To that end, fibrous material, for instance cellulose, is ground to a certain desired fineness.

The grinding apparatus according to the embodiment of FIG. 1 contains a housing 1 equipped with stationary side walls 2 and 3, between which there is arranged a moveable disc 4, constituting a moveable part, which is sealingly guided by means of a cylindrical collar 5 in two sealing rings 6 attached in the housing 1. The side wall 3 and the disc or disc member 4 are provided at the mutually confronting sides with stator grinding tool sets or grinding tools 7, sometimes also referred to as grinding tool fittings. Such side wall 3 and disc 4 or equivalent structure delimit a grinding chamber or compartment 8 within the equipment housing 1. Arranged with the grinding chamber 8 is a substantially disc-shaped rotor 10. This rotor 10 is equipped with rotor grinding tool sets or grinding tools 11, also sometimes referred to as grinding tool fittings. Rotor 10 is arranged upon a shaft 12 which is mounted in a cantilever fashion in a bearing 13 affixed to the housing 1 by means of a bracket 9 or equivalent attachment arrangement. The rotor shaft 10 is operatively coupled by means of a clutch or coupling 14, enabling axial movements to be accomplished, with a drive motor 15 which has only been partially illlustrated but may be of any conventional design suitable for driving the rotor shaft 12 and thus the rotor 10.

The wall 3 of the housing 1 is equipped with a central opening 16 which surrounds the shaft 12. The opening 16 is closed by a hood member 17 attached at the housing 1. Within the hood member 17 there is sealingly guided the shaft 12. This hood member 17 is connected by means of a stud or connection 18 with an infeed line or conduit 20 provided with a feed or delivery pump 21 or the like. This infeed line or conduit 20 allows for the infeed of the stock or fibrous material which is to be ground. The moveable disc 4 contains a central bowed-out or domed portion 22 which enlarges the grinding chamber 8 and is connected with a piston rod 23 extending coaxially with respect to the shaft 12. The moveable disc or disc member 4 is also connected with a number of, for instance three guide pins 24 arranged axially parallel to one another and distributed in the circumferential direction. These guide pins 24 are guided to be axially displaceable in guides 25 provided at the side wall 2. The piston rod 23 is sealingly guided through the wall 2 and carries at its end protruding out of the housing 1 a substantially disc or plate-shaped piston 26. This piston or piston member 26 is sealingly guided in a substantially pot-shaped cylinder 27 attached to the wall 2 and is moveable in the axial direction of the piston rod 23. The piston 26 separates a pressing or contact chamber 28 which can be impinged with a pressurized fluid medium in the sense of having the grinding tool sets approach one another from a lift-off chamber 30 which can be pressure impinged in the opposite sense or direction for the lift-off of the grinding tools. On the other hand, the disc 4 limits together with the wall 2 of the housing 1 a second pressing or contact chamber 31.

Figure 3:
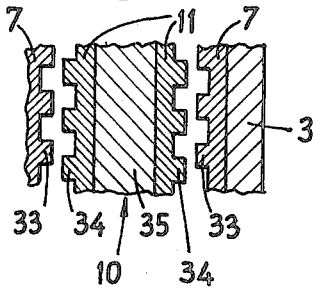
FIG. 3 is a partial sectional view of the arrangement of FIG. 1, taken substantially along the line III—III thereof.

The grinding tools 7 and 11 are constructed so as to have a ring-shaped configuration and possess rib-like teeth 33 and 34, respectively, as best seen by referring to FIG. 3, these teeth extending transverse to the direction of revolution of the rotor 10. These teeth 33 and 34, in order to avoid any excessive formation of noise are not as is known arranged in radial direction, rather at an inclination or obliquely. The rotor grinding tool sets 11 are arranged upon a carrier or support ring 35 which is affixed by means of the arms 36 at a hub 37 of the rotor 10.

The fibrous material which is to be ground is introduced in the form of a suspension and fed from the infeed line or conduit 20 by means of the connection 18 into the central region of the grinding chamber or compartment 8. The stock suspension thereafter flows through the grinding gap formed between the grinding tool sets 7 and 11, and the fibrous material is ground between the grinding teeth 33 and 34, and from the peripheral region of the grinding chamber 8 the ground fibrous material in the suspension is delivered by means of an outfeed or delivery line 38 to a not particularly illustrated device of the papermaking machine.

Both of the pressing or pressure chambers 28 and 31 are connected at two compressed air lines 40 and 41 connected in parallel. Each of the compressed air lines 40 and 41 contain a respective regulation valve 44 and 45 which can be controlled by a regulator 42 and 43, respectively. The compressed air lines or conduits 40 and 41 are connected with a control device or control means 48 by means of a common connection line 46 which contains an adjustable throttle element 47. The lift-off chamber 30 is connected by means of a compressed air line 50 likewise with such control device 48. The compressed air lines 40 and 41 are also connected by means of a respective outflow or delivery line 51 and 52 with the connection line or conduit 46. These outflow or delivery lines 51 and 52 are shunted or bridged by the related regulation or regulating valve 44 and 45 and the throttle element 47. The outflow or delivery lines 51 and 52 are connected in parallel and contain a respective check or non-return valve 53 through which flow can occur only in the direction from the associated pressing chamber 28 and 31, respectively, towards the control device or control means 48.

This control device 48 contains a throughflow element 54 which can be adjusted by means of an electromagnetic adjustment or positioning device 55 between two throughflow positions, where such throughflow element 54 either flow communicates the connection line 46 or the pressure line 50 with an infeed line 56 or with an outflow connection 57, as the case may be. The infeed line 56 contains an adjustable throughflow element 58 and is connected with a supply line or conduit 60 which is operatively coupled with a not particularly illustrated but conventional compressed air source.

The adjustment or positioning device 55 can be actuated by means of a safety regulator 61. This safety regulator 61 is connected by means of signal lines 62 and 62*a* with a pressure pick-up or pressure measuring device 63 which measures in the infeed line 20 the pressure prevailing within the internal compartment of the housing 1. The pressure pick-up 63 is connected with the supply line 60 by means of a connection line or conduit 64 containing an adjustable throughflow element 65.

The regulator 43, constituting a compensation force regulator, operatively associated with the pressing or pressure chamber 31 is likewise connected with the signal line 62 and with a signal line 66 which is coupled with a conventional pressure feeler arranged in the pressure line 41. The regulator of regulator means 42, constituting a grinding force regulator, associated with the pressing or pressure chamber 28 is adjusted to a set or reference value of the pressure which builds-up in the pressing chamber 28 by means of an actuation device, here shown constituted by a control line 67, independently of the remaining regulation arrangement. This grinding force regulator 42 is connected with a signal line 68 which is coupled with a conventional pressure feeler or sensor arranged in the pressure line or conduit 40. The control line 67 can be connected, for instance, with a computer for the automatic change of the set or reference value; yet the setting of the set value also can be accomplished manually or by using a positioning motor.

In the illustrated switching position of the control device 48 the lift-off chamber 30 is impinged with compressed air by means of the infeed line 56 and the connection line 50, and the compressed air enclosed in the pressing or pressure chambers 28 and 31 can escape by means of the outflow or delivery lines 51 and 52.

During operation of the system the control device 48 assumes a throughflow position where the connection line 46 is connected with the compressed air-infeed line 56 and the compressed air line 50 is coupled with the outflow connection or stud 57. By means of the infeed line 20 there is pumped into the housing 1 the suspension which is to be processed. The rotor 10 assumes a position which is approximately centrally located between the stator grinding tool sets or grinding tools 7 and forms therewith the grinding gap through which flows the suspension towards the outside and into the outfeed line 38. The pressure pick-up 63 delivers a measuring signal corresponding to the liquid pressure prevailing internally of the housing 1, by means of the signal line 62, to the compensation force regulator 43 of the regulation valve 45, by means of which it is possible to set or adjust the pressure of the compressed air infed to the pressing or pressure chamber 31 at a value such that a compensation force acts upon the disc or disc member 4. The adjustment of the pressure is accomplished as a function of the internal pressure of the housing 1 and the piston surfaces of the disc 4 impinged by the compressed air. This compensation force, which as stated acts upon the disc 4, compensates the pressure or compressive force effective at the disc 4 and resulting from the internal pressure of the housing 1.

By means of the regulation valve 44 arranged in the pressure line 40 the compressed air is infed to the pressing or pressure chamber 28 at a predetermined pressure, corresponding to the set or reference value which has been adjusted at the grinding force regulator 42. Consequently, due to the infeed of the compressed air there is exerted upon the moveable disc 4, by means of the correspondingly pressure impinged piston 26, an additional pressing or compressing force other than the grinding force which adjusts itself and which additional pressing force is independent of the previously mentioned compensation force. The maximum value of the pressure which is adjusted in the pressing or pressure chambers 28 and 31 is governed by the throttle element 47 which is arranged in the common connection line or conduit 46.

By virtue of the described pneumatic adjustment device the disc or disc member 4 and the rotor 10 are yieldingly retained in their predetermined operating positions, so that any possible wear which has occurred at the grinding tool sets 7 and 11 is compensated by an appropriate automatic readjustment of the disc 4. Consequently, it is possible to maintain the width of the grinding gap, and thus, the grinding load essentially constant in a particularly simple manner, without the need to use for this purpose a separate regulation, for instance an electronic regulation system. Due to the use of the compressible pressurized medium it is further-more possible for the disc member or disc 4 to elastically give, for instance if smaller foreign bodies or contaminants pass through one of the grinding gaps, so that the grinding apparatus is load relieved, especially the drive motor. Should in the presence of a more severe disturbance, for instance upon dropping of the stock pressure due to absence of the suspension, the pressure in the internal compartment 8 of the housing 1 drop below a predetermined set or reference value, then a cut-off signal is transmitted from the pressure pick-up or pressure measuring device 63 by means of the signal line 62*a* to the safety regulator 61. Consequently, the control device or control means 48 is switched back into the illustrated position where, due to the infeed of compressed air into the lift-off chamber 30 and the withdrawal of the compressed air flowing out of the pressing or pressure chambers 28 and 31 through the check or non-return valves 53, there is ensured for a rapid load relief of the grinding apparatus.

As soon as the pressure of the suspension again reaches the minimum value which has been set at the pressure pick-up 63, then by means of a signal delivered by the pressure pick-up or pressure measuring device 63 via the signal line 62*a* to the safety regulator 61, the control device 48 is switched out of the illustrated switching position into the operating position where the compressed air lines 40 and 41 are connected to the infeed line or conduit 56. Hence, the pressing or pressure chambers 28 and 31 are again loaded or pressure impinged in accordance with the prior set grinding load.

At the wall 1' of the housing 1 which surrounds the disc member or disc 4 there is provided a control channel 70 which flow communicates an annular or ring-shaped chamber 71 with an outflow or delivery line 72. This ring-shaped chamber 71 is located between both of the sealing rings 6. By virtue of this arrangement it is possible to detect possibly arising untightness at the region of the sealing rings 6 which is correlated to the grinding chamber or compartment 8, since liquid which escapes from the grinding chamber 8 into the ring-shaped chamber 71 can be withdrawn through the outflow or delivery line 72.

With the modified construction of grinding apparatus as depicted in FIG. 2, it will be seen that the housing 1 possesses a side wall 76 equipped with openings 75. This side wall 76 carries a cylinder or cylindrical member 77 which is divided by an intermediate wall or partition 78 into two partial chambers or spaces 130 and 131, each of which are bounded by a respective end wall 79 and 80, respectively. The moveable disc 4 is connected with a piston rod 81 which is sealingly guided in the intermediate wall 78 and in the end wall 79 and which carries the piston 26 and a second piston 82. These pistons or piston members 26 and 82 are sealingly guided in both of the partial chambers 130 and 131 of the cylinder 77, and the piston 26 separates the first pressing or pressure chamber 28 from the lift-off chamber or space 30, and the piston 82 limits the second pressing or pressure chamber 31. Here, the disc 4 does not possess any piston surface which is impinged by a pressurized medium and is guided within the housing 1 only by a single sealing ring 6.

With this embodiment the compressed air lines 40 and 41 leading to both of the pressing or pressure chambers 28 and 31 are connected in parallel by means of a connection line 83 and coupled by means of a common regulation valve 44' at the connection line 46 leading to the control device 48. The regulation valve 44' is arranged, in the embodiment under discussion, in the compressed air line or conduit 40. The regulation valve 44' can be acted upon by a regulator or regulation device 84. This regulation device 84, constituting a combined compensation force regulator and grinding force regulator can be adjusted, on the one hand, by means of the actuation device represented as a control line 67 to a set value, corresponding to the predetermined grinding force, of the pressure building-up in both of the pressing or pressure chambers 28 and 31 and, on the other hand, can be adjusted by means of the signal lines 66 and 62, respectively, connected with the pressure line 41 and with the pressure pick-up or measuring device 63, in accordance with the compensation force which is to be transmitted in each case in order to compensate the internal pressure prevailing in the housing 1.

Also with this embodiment there are thus detected both of the components of the axial force effective in the grinding apparatus and formed by the grinding force and the compensation force. In the not particularly illustrated operating position of the control device 48, where the throughflow element 54 connects the connection line 46 with the infeed line 56, the compressed air infeed to both of the pressing or pressure chambers 28 and 31 is controlled by the common regulator 84. Upon dropping below a predetermined minimum value of the stock pressure prevailing in the grinding chamber 8, as already heretofore described, the control device 48 is switched back by means of the signal line 62*a* and the safety regulator 61 into the illustrated operating position where, through the infeed of compressed air to the lift-off chamber 30 and expulsion of the compressed air out of the pressing chambers 28 and 31, the grinding apparatus is relieved of load.

Figure 4:
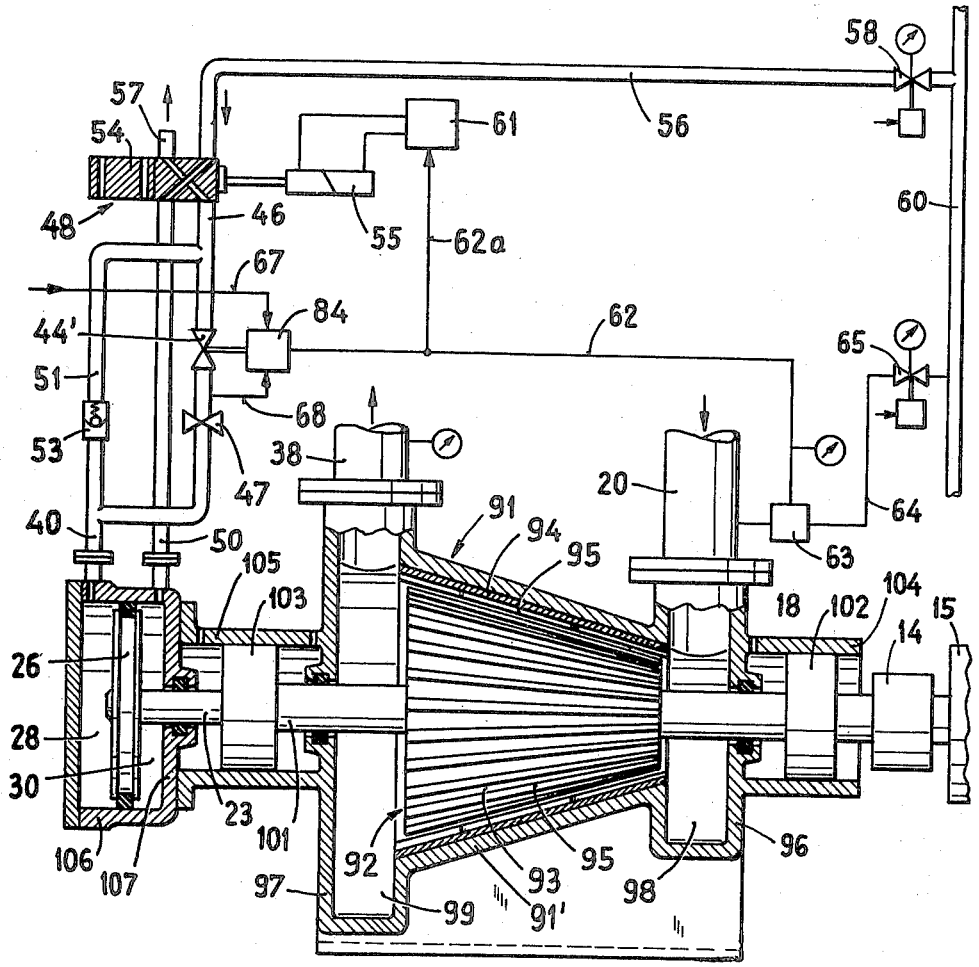
FIG. 4 again is a schematic illustration of part of a grinding apparatus in fragmentary sectional view according to a third embodiment of the invention.

With the modified construction of grinding apparatus as shown in FIG. 4 there is depicted a so-called "cone refiner", which contains a conical housing 91 and truncated conical rotor 92 arranged within the substantially conical housing 91. The jacket or outer surface of the rotor 92 and the wall 91' of the housing 91 which surrounds the rotor 92 are equipped with grinding tools or grinding tool sets 93 and 94. These grinding tools 93 and 94 possess substantially rib-like grinding teeth 95 which each extend in the direction of the generatrixes of the rotor 92. The grinding gap which is to be formed between the grinding tool sets 93 and 94 is governed by the axial position of the rotor 92 relative to the surrounding housing wall 91'. The housing 91 is closed at both ends by end walls 96 and 97, each of which are arranged at an axial spacing from the related end surface of the rotor 92. Consequently, the end wall 96 bounds an inlet chamber 98 arranged axially forwardly of the smaller end surface of the rotor 92. This inlet chamber or compartment 98 is connected with the infeed line 20 for the suspension which is to be processed.

On the other hand, the end wall 97 bounds an outlet chamber or compartment 99 of the housing 91 and which merges with the larger end surface or face of the rotor 92. This outlet chamber 99 is connected with the outlet or delivery line 38.

The rotor 92 is arranged upon a rotatable shaft 101 which sealingly is guided through the end walls 96 and 97 and is mounted in two axially displaceable bearings 102 and 103. These bearings 102 and 103 are each guided in a respective connection or stud 104 and 105, respectively, or equivalent structure which is attached at the related end wall 96 and 97, respectively. The connection or stud 105 is coupled with a cylinder or cylinder member 106 which is closed at both ends. Sealingly guided in the cylinder 106 is the piston 26. The piston rod 23 is sealingly guided in the end wall 107 of the cylinder 106, this end wall 107 confronting the connection stud 105. Also, the piston rod 23 is connected with the bearing 103.

With this system design the axial position of the rotor 92 and the compensation and grinding force acting upon such rotor 92 are governed by the pressure which has been set at the single pressing or pressure chamber 28. This pressure can be controlled in the already described manner, on the one hand, by means of the combined compensation force regulator and grinding force regulator 84 as a function of the pressure prevailing in the inlet chamber 98 and, on the other hand, in accordance with the reference or set value which has been adjusted by means of the control line 67.

It should be understood that the inventive control of the pressing or contact force also can be benefically used for grinding apparatuses equipped with more than two piston-and-cylinder-units, which for instance are connected in parallel in known manner.

While there are shown and described present preferred embodiments of the invention it is to be distinctly understood that the invention is not limited thereto, but may be otherwise variously embodied and practiced within the scope of the following claims. ACCORDINGLY,

What we claim is:

1. A grinding apparatus for fibres contained in a stock suspension for use in the paper industry, comprising:

a housing;

a rotor defining an element and rotatably mounted within said housing;

at least a first grinding tool means provided for said rotor;

a wall part defining a second element and coacting with said rotor;

a second grinding tool means provided for said wall part;

both of said grinding tool means defining therebetween a grinding gap;

one of said elements carrying its grinding tool means being moveable in relation to the other element carrying its grinding tool means, in axial direction of the rotor, towards and away from said other element, in order to adjust the grinding gap between said first and second grinding tool means;

a piston-and-cylinder unit which can be impinged by a pressurized fluid medium for adjusting said moveable part;

said piston-and-cylinder unit containing a pressing chamber which is effective in the sense of having both of said grinding tool means approach one another and a lift-off chamber which is effective in a lift-off direction in the sense of moving apart both of said grinding tool means;

a regulation device for influencing the pressure of the pressurized fluid medium;

said regulation device containing a compensation force regulator which, as a function of the pressure prevailing in an internal space of the housing causes a compensation of the pressure force acting by virtue of such pressure upon the moveable element;

a pressure measuring means for measuring the pressure of the suspension in the housing;

a signal line for operatively connecting the compensation force regulator with said pressure measuring means;

the compensation force regulator bringing the pressure of the pressurized fluid medium to a pressure which is in a predetermined relationship to the pressure of the suspension;

said regulation device further being provided with a grinding force regulator; and said grinding force regulator enabling influencing the pressure of the pressurized fluid medium as a function of a set value signal and adjustment of a desired grinding force.

2. The grinding apparatus as defined in claim 1, further including:

control line means for infeeding a set value signal.

3. The grinding apparatus as defined in claim 1, wherein:

said piston-and-cylinder unit contains at least two different pressing chambers which are effective in the same direction;

a separate infeed line for the pressurized fluid medium at which there is arranged the compensation force regulator;

a separate infeed line for the pressurized fluid medium at which there is arranged the grinding force regulator; and said separate infeed lines respectively each leading to one of the pressing chambers.

4. The grinding apparatus as defined in claim 3, wherein:

said compensation force regulator and the grinding force regulator are assembled together into a common regulation device; and a common pressure regulating valve influenced by said common regulation device.

5. The grinding apparatus as defined in claim 1, further including:

control means for switching the infeed of the pressurized fluid medium from the pressing chamber to the lift-off chamber;

a line leading to the pressing chamber;

a regulation valve located in said line leading to the pressing chamber; and a one-way valve bridging said regulation valve and enabling rapid outflow of the medium from said pressing chamber.

6. The grinding apparatus as defined in claim 5, further including:

a safety regulator;

said control means being connected with said safety regulator;

a signal line for connecting said safety regulator with said pressure measuring means for measuring the pressure of the suspension in the housing; and said safety regulator placing said control means in a lift-off position when the pressure of the suspension falls below a predetermined value.

7. The grinding apparatus as defined in claim 1, wherein:

said pressurized fluid medium comprises compressed air.

8. The grinding apparatus as defined in claim 1, wherein:

said moveable part comprises an intermediate wall of said housing;

a fixed outer wall surrounding said intermediate wall; and said outer wall forming one of said cylinder chambers in which there is guided the intermediate wall in the manner of a piston within a cylinder.

9. A grinding apparatus for fibres contained in a stock suspension for the use in the paper industry, comprising:

a housing;

a rotor rotatably mounted within said housing;

grinding tools defining at least one grinding gap provided for said rotor;

a piston-and-cylinder unit which can be impinged by a pressurized fluid medium for adjusting said grinding tools;

said piston-and-cylinder unit containing a pressing chamber which is effective in the sense of decreasing the size of the grinding gap and a lift-off chamber which is effective in a lift-off direction in the sense of increasing the size of the grinding gap;

a regulation device for influencing the pressure of the pressurized fluid medium;

said regulation device containing a compensation force regulator which, as a function of the pressure prevailing in an internal space of the housing causes a compensation of the pressure force acting by virtue of such pressure upon a predetermined part;

pressure measuring means for measuring the pressure of the suspension in the housing;

a signal line for operatively connecting the compensation force regulator with said pressure measuring means;

the compensation force regulator bringing the pressure of the pressurized fluid medium at a pressure which is in a predetermined relationship to the pressure of the suspension;

said regulation device further being provided with a grinding force regulator; and said grinding force regulator enabling influencing the pressure of the pressurized fluid medium as a function of a set value signal and adjustment of a desired grinding force.

* * * * *